US011358023B1

(12) United States Patent
Chin

(10) Patent No.: US 11,358,023 B1
(45) Date of Patent: Jun. 14, 2022

(54) MULTIPURPOSE WORKOUT CHAIR

(71) Applicant: T.K. Chin Company Ltd., Taipei (TW)

(72) Inventor: Taan-Kuan Chin, Taipei (TW)

(73) Assignee: T.K. Chin Company Ltd., Taipei (TW)

( * ) Notice: Subject to any disclaimer, the term of this patent is extended or adjusted under 35 U.S.C. 154(b) by 31 days.

(21) Appl. No.: 17/144,343

(22) Filed: Jan. 8, 2021

(30) Foreign Application Priority Data

Nov. 26, 2020 (TW) ..... 109141652

(51) Int. Cl.
*A63B 21/00* (2006.01)
*A63B 23/02* (2006.01)

(52) U.S. Cl.
CPC ..... *A63B 21/4029* (2015.10); *A63B 23/0211* (2013.01); *A63B 2208/0228* (2013.01); *A63B 2208/0252* (2013.01); *A63B 2210/02* (2013.01); *A63B 2225/09* (2013.01)

(58) Field of Classification Search
CPC . A63B 21/4029; A63B 26/00; A63B 21/4027; A63B 23/0211; A63B 2208/0228; A63B 2208/0252; A63B 2210/02; A63B 2225/09; A63B 21/4034; A63B 21/0407; A63B 21/1609; A63B 23/0355; A63B 21/154; A63B 21/4039; A63B 21/0552; A63B 23/04; A63B 21/4035; A63B 23/03575; A63B 21/153; A63B 23/03541; A63B 21/0442; A63B 21/16; A63B 2071/027; A63B 2225/093; A63B 21/00185; A63B 21/00069; A63B 22/0046; A63B 2208/0233; A63B 21/4013; A63B 2210/50; A63B 21/00065; A47C 9/002
USPC ..... 482/142
See application file for complete search history.

(56) References Cited

U.S. PATENT DOCUMENTS 4,838,547 A * 6/1989 Sterling ..... A63B 23/00 482/130
5,681,250 A * 10/1997 Hoover ..... A63B 23/03575 482/142
5,833,590 A * 11/1998 Chiu ..... A63B 23/0211 482/133
D528,614 S * 9/2006 McVay ..... D21/687
7,361,128 B2 * 4/2008 Chen ..... A63B 23/0211 482/145

(Continued)

FOREIGN PATENT DOCUMENTS

CN 201279367 Y 7/2009
EP 2156766 A1 2/2010

(Continued)

*Primary Examiner* — Andrew S Lo
*Assistant Examiner* — Andrew M Kobylarz
(74) *Attorney, Agent, or Firm* — Karin L. Williams; Alan D. Kamrath; Mayer & Williams PC

(57) ABSTRACT

A multipurpose workout chair is an exercising equipment that not only can be used for workout training, but also can be used as a chair. The multipurpose workout chair includes adjustment devices and other components acting with each other which allows the multipurpose purpose chair to be changed into various configurations according to different training methods and each of the training methods may be executed by one or more different muscles.

16 Claims, 16 Drawing Sheets

(56) References Cited

U.S. PATENT DOCUMENTS

| | | | | |
|---|---|---|---|---|
| 7,708,670 | B2 * | 5/2010 | Bowser | A63B 21/4049 482/57 |
| 7,967,733 | B2 * | 6/2011 | Abelbeck | A63B 22/001 482/62 |
| 2002/0165071 | A1 * | 11/2002 | Wu | A63B 26/00 482/142 |
| 2007/0197359 | A1 * | 8/2007 | Teng | A63B 23/03575 482/142 |
| 2008/0061615 | A1 * | 3/2008 | McBride | A47C 9/002 297/325 |
| 2011/0301002 | A1 * | 12/2011 | Sebastian | A63B 21/068 482/142 |
| 2013/0029816 | A1 * | 1/2013 | Park | A61H 1/0296 482/142 |
| 2013/0157824 | A1 * | 6/2013 | Chen | A63B 21/4033 482/142 |

FOREIGN PATENT DOCUMENTS

| | | |
|---|---|---|
| TW | M589570 | 1/2020 |
| WO | WO2006096883 A2 | 9/2006 |

* cited by examiner

MULTIPURPOSE WORKOUT CHAIR

BACKGROUND OF THE INVENTION

1. Field of the Invention

The present invention relates to an exercise equipment, especially to a workout chair that not only can be used for multiple workout exercises, but also can be used as a common chair.

2. Description of the Prior Arts

Nowadays, workout has been more and more popular than ever. Workout not only helps people to reduce extra calories, but also helps people to keep in a better shape. Therefore gyms have been the first choice of workout venue for the general public. But not everyone has the time for gym exercise, and lack of exercise can lead to multiple health issues.

Taiwan Patent No. M589570 relates to home workout equipment that allows users to exercise without going to gyms, benefiting everyone who is occupied by work or other obligations. Although the home workout equipment allows users to exercise at home, the training categories are limited. After a period of using such equipment, the trainee's muscles may grow unevenly, which not only makes the body shape grow away from expectations, but also results in failure or damage of body functions such as kyphosis or scoliosis. Furthermore, the workout equipment on the market is limited to exercise only, being limited in functionality.

To overcome the shortcomings, the present invention provides a multipurpose workout chair to mitigate or obviate the aforementioned problems.

SUMMARY OF THE INVENTION

The main objective of the present invention is to provide a multipurpose workout chair that can be used as a workout equipment and a furniture.

The multipurpose workout chair has a seat, two support structures, a backrest, two power twisters, two connection components, two chair legs, and multiple adjustment devices. The support structures are respectively mounted on two opposite sides of the seat. The backrest has two ends opposite to each other. One end of each one of the power twisters is connected to a respective one of the ends of the backrest. The connection components are each respectively connected to another end of each one of the power twisters, and each of said another ends being away from the backrest. The two chair legs are defined as a first chair leg and a second chair leg. The adjustment devices defined as two first adjustment devices, two second adjustment devices, and two third adjustment devices. Each one of the first adjustment devices connects one of the support structures and a respective one of the connection components and is configured to adjust an angle between said one of the support structures and said respective one of the connection components. Each one of the second adjustment devices connects one of the support structures and a respective one of ends of the first chair leg and is configured to adjust an angle between said one of the support structures and the first chair leg. Each one of the third adjustment devices connects one of the support structures and a respective one of ends of the second chair leg and is configured to adjust an angle between said one of the support structures and the second chair leg.

The multipurpose workout chair not only can be used for exercise, but also can be used as furniture. By the multiple adjustment devices and other components interacting with each other, the multipurpose workout chair can be used in various ways and configurations along with the various methods, which satisfies multipurpose usage.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
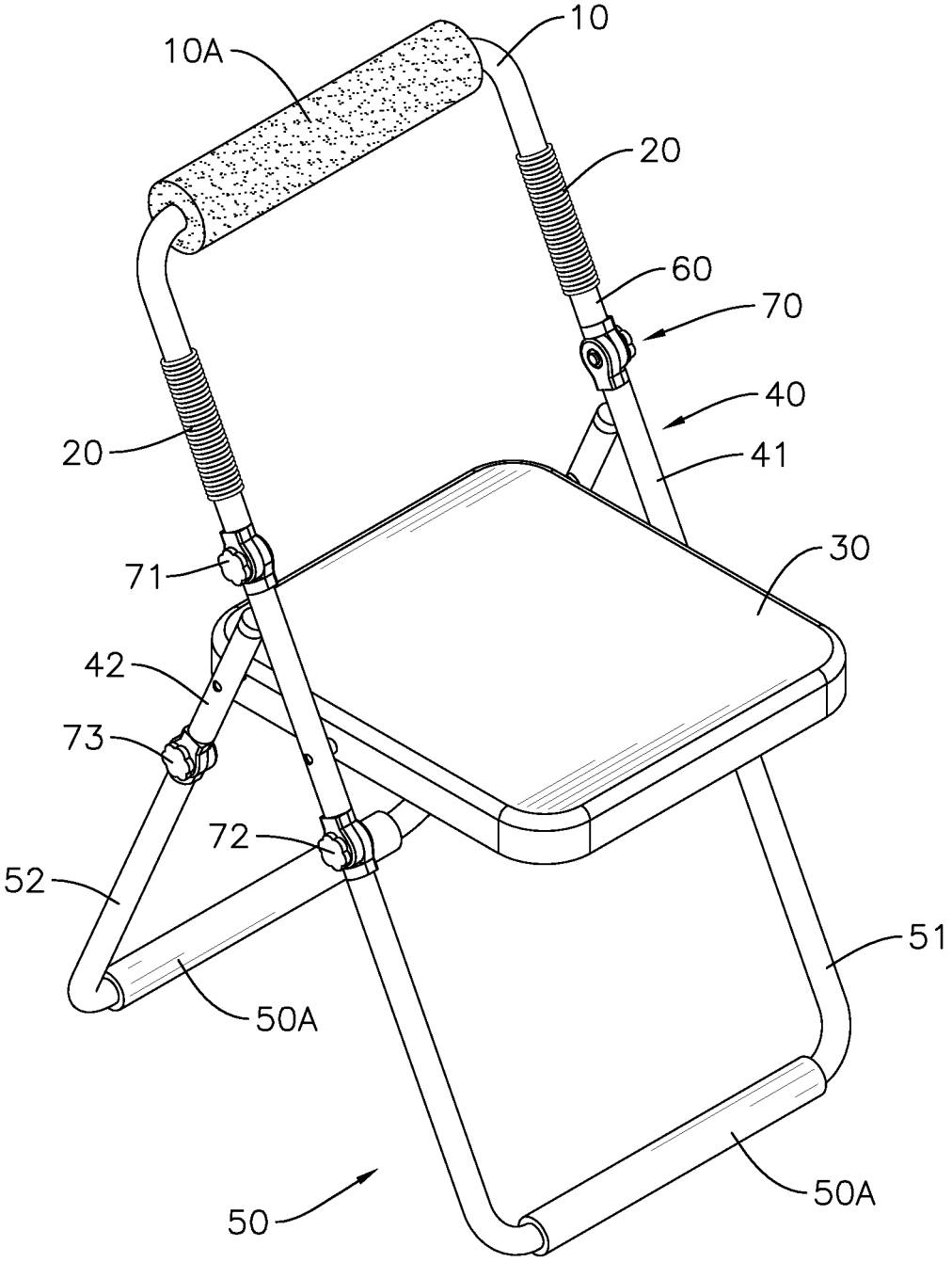
FIG. 1 is a perspective view of a multipurpose workout chair in accordance with a first embodiment of the present invention.

With reference to FIG. 1, a multipurpose workout chair in accordance with the present invention is provided. The multipurpose workout chair not only can be used for exercise, but also can be used as a regular chair. The multipurpose workout chair comprises a backrest 10, two power twisters 20, a seat 30, two support structures 40, two chair legs 50, two connection components 60, and multiple adjustment devices 70. The relative angles or relative positions between components of the multipurpose workout chair in the present invention can be adjusted based on the needs in order to present multiple embodiments and configurations.

In the first embodiment (FIG. 1) of the present invention, a rod is used as the backrest 10, and a cushion pad 10A can be added for releasing the pressures from the body during the exercise. Two opposite ends of the backrest 10 are each respectively connected with one end of a respective one of the power twisters 20. When a user applies forces on the backrest 10, the power twisters 20 would be driven and bent by the backrest 10. As the power twisters 20 are bent, the power twisters 20 naturally generate resilience forces towards the opposite direction of the applied forces, thereby allowing the user to exercise by resistance training.

The support structures 40 are respectively mounted on two opposite sides of the seat 30. Each support structure 40 comprises a first support rod 41 and a second support rod 42. The two chair legs 50 may be a first chair leg 51 and a second chair leg 52. Two ends of the first support rod 41 are respectively connected to one of the connection components 60 and one end of the first chair leg 51 via the adjustment devices 70. Two ends of the second support rod 42 are respectively connected to one of the ends of the second chair leg 52 via the adjustment devices 70 and the first support rod 41. The connection components 60 are each connected to another end of a respective one of the power twisters 20. Said another end of the power twister 20 is opposite the backrest 10, and is configured to connect one of the ends of the first support rod 41.

Figure 2:
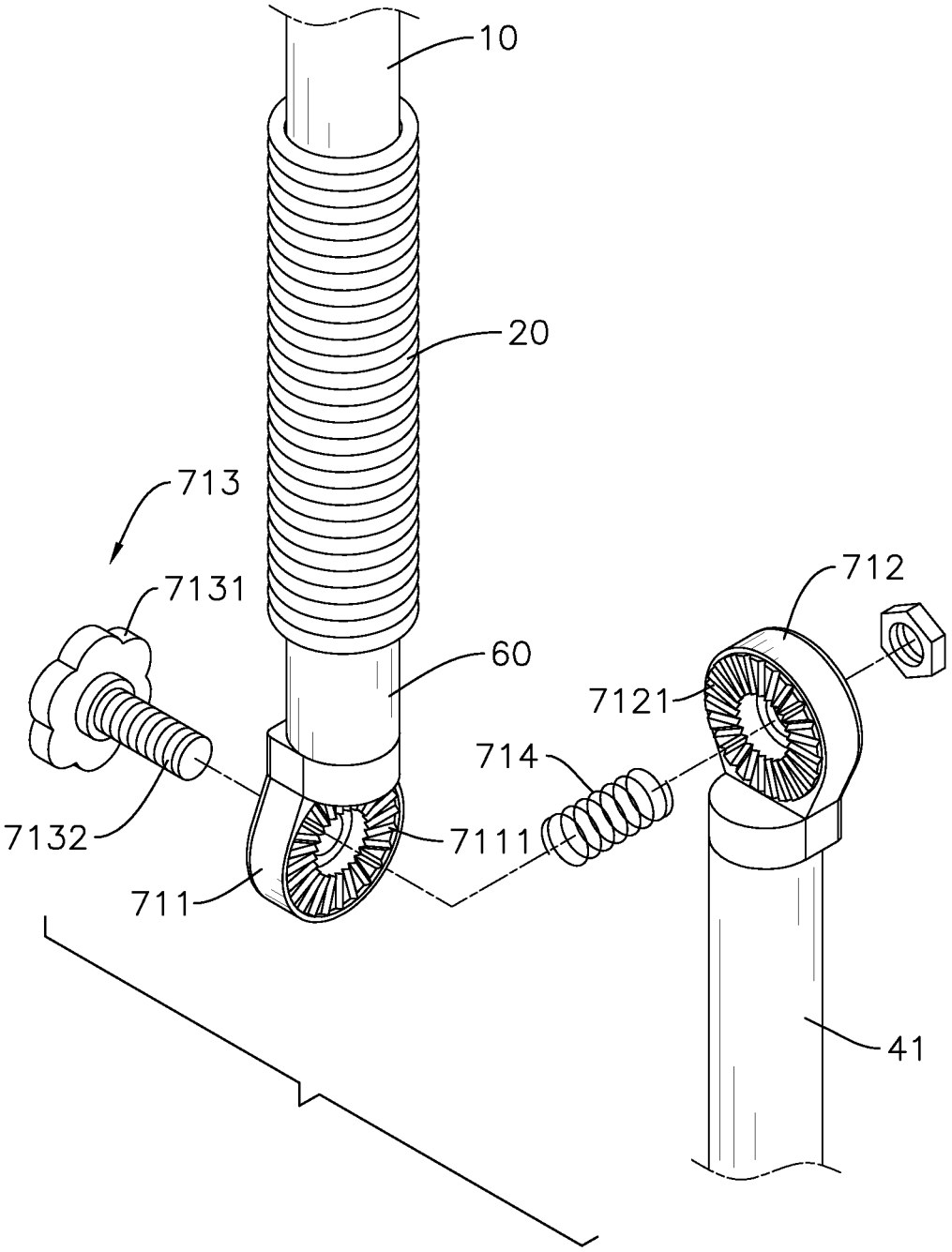
FIG. 2 is an exploded view of an adjustment device of the multipurpose workout chair in FIG. 1.

Then please refer to FIG. 1 and FIG. 2. The multiple adjustment devices 70 comprise two first adjustment devices 71, two second adjustment devices 72, and two third adjustment devices 73. Each one of the first adjustment devices 71 connects a respective one of the first support rods 41 and a respective one of the connection components 60 and is configured to adjust an angle between said one of the first support rods 41 and said respective one of the connection components 60. Each one of the second adjustment devices 72 connects a respective one of the first support rods 41 and one end of the first chair leg 51. The second adjustment devices 72 are configured to adjust an angle between said first support rod 41 and the first chair leg 51. The first adjustment devices 71 and the second adjustment devices 72 are respectively mounted on the two ends of the first support rods 41. Each one of the third adjustment devices 73 connects one of the second support rods 42 and one end of the second chair leg 52. The third adjustment devices 73 are configured to adjust an angle between said one of the second support rods 42 and the second chair leg 52.

Each of the first adjustment devices 71 comprises a first base 711, a second base 712, a threaded component 713, and a detaching spring 714. The first base 711 is connected to the corresponding one of the first support rods 41. A surface of the first base 711 comprises multiple first gear teeth 7111. The second base 712 is connected to the corresponding one of the connection components 60. A surface of the second base 712 comprises multiple second gear teeth 7121. In other embodiments, the first base 711 can be connected to the connection components 60 instead, and the second base 712 can be connected to one of the first support rods 41.

The threaded component 713 comprises a first end 7131 and a second end 7132. The threaded component 713 is mounted through the first base 711 and the second base 712. A nut is mounted on the second base 712 and cannot be rotated relative to the second base 712, and additionally, the second end 7132 of the threaded component 713 is screwed in the nut. Therefore, when the second end 7132 is screwed in the nut, the first end 7131 of the threaded component 713 and the nut may clamp the first base 711 and the second base 712, thereby tightening the connection between the first base 711 and the second base 712.

The surface with the first gear teeth 7111 of the first base 711 faces toward the surface with the second gear teeth 7121 of the second base 712. The first gear teeth 7111 are selectively engaged with the second gear teeth 7121. The detaching spring 714 is mounted between the first base 711 and the second base 712 and is configured to separate the first base 711 and the second base 712. When the first gear teeth 7111 are engaged with the second gear teeth 7121, the first base 711 cannot be rotated with respect to the second base 712. Meanwhile, the first end 7131 of the threaded component 713 and the nut apply forces on the first base 711 and the second base 712 toward each other, and the detaching spring 714 is compressed between the first base 711 and the second base 712. Due to the compression, the detaching spring 714 applies forces toward the first base 711 and the second base 712. When adjustment is needed, the threaded component 713 can be released from the nut and thereby the first base 711 and the second base 712 are separated by the detaching spring 714. Therefore, the first gear teeth 7111 and the second gear teeth 7121 are disengaged and the first base 711 and the second base 712 can be rotated with respect to each other for the adjustment.

The structure and the mechanism of the first adjustment devices 71, the second adjustment devices 72, and the third adjustment devices 73 are similar. Therefore, only the first adjustment devices 71 would be described in this specification. A first base of each second adjustment device 72 is connected to a respective one of the first support rods 41, a second base of each second adjustment device 72 is connected to a respective one end of the first chair leg 51, and the first base and the second base of each second adjustment device 72 can be rotated with respect to each other. A first base of each third adjustment device 73 is connected to a respective one of the second support rods 42, a second base of each third adjustment device 73 is connected to one end of the second chair leg 52, and the first base and the second base of each third adjustment device 73 can also be rotated with respect to each other.

Figure 11:
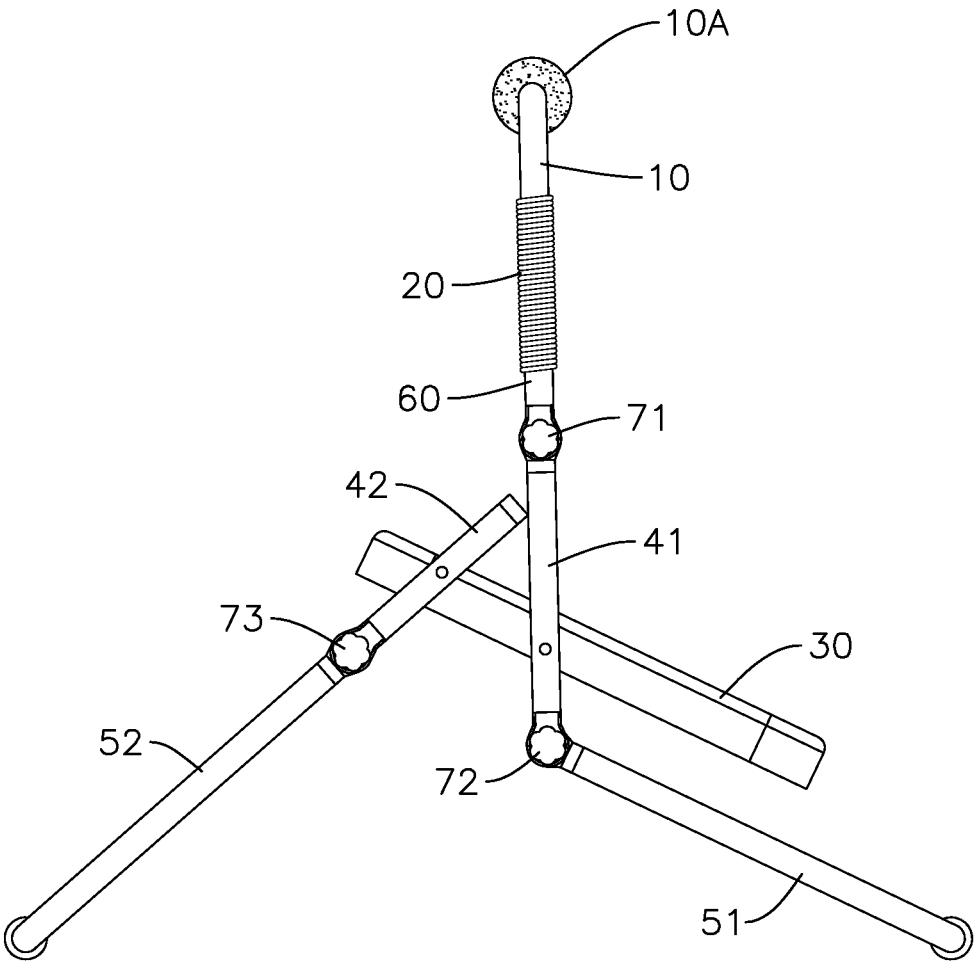
FIG. 11 is the third configuration of the multipurpose workout chair in FIG. 1.
Figure 12:
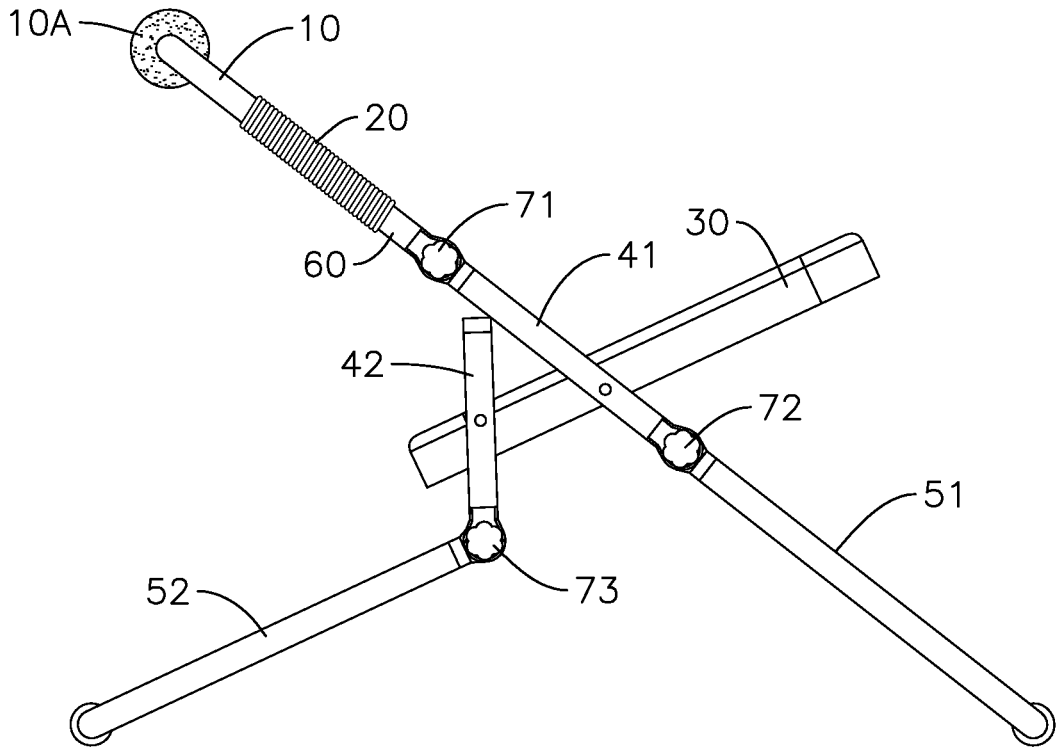
FIG. 12 is the fourth configuration of the multipurpose workout chair in FIG. 1.
Figure 13:
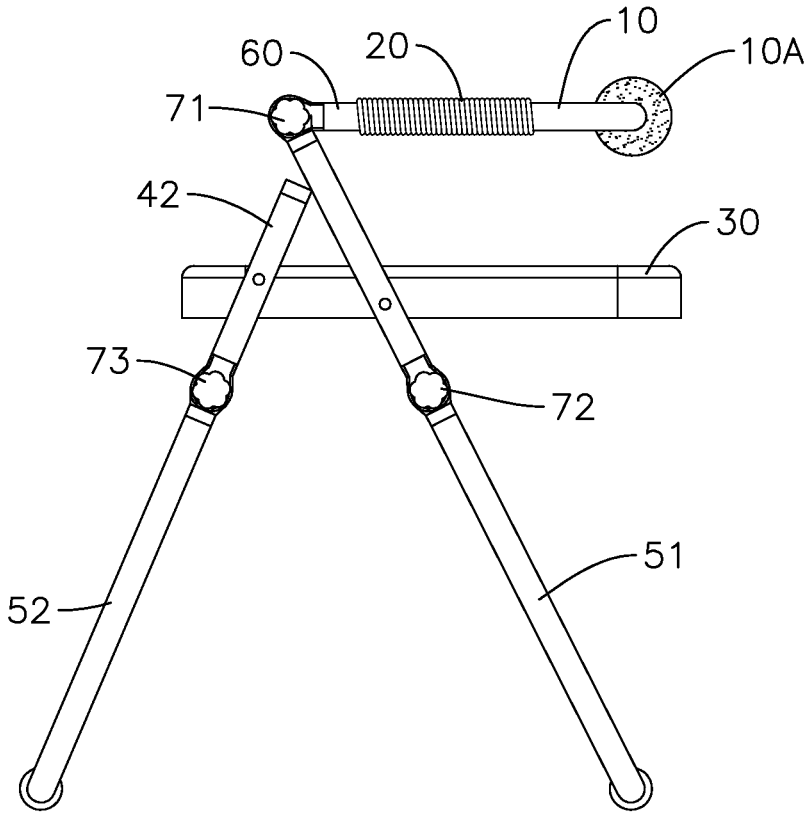
FIG. 13 is the fifth configuration of the multipurpose workout chair in FIG. 1.

Then please refer to FIG. 11 to FIG. 13. The first adjustment devices 71, the second adjustment devices 72, and the third adjustment devices 73 are working individually.

Figure 3:
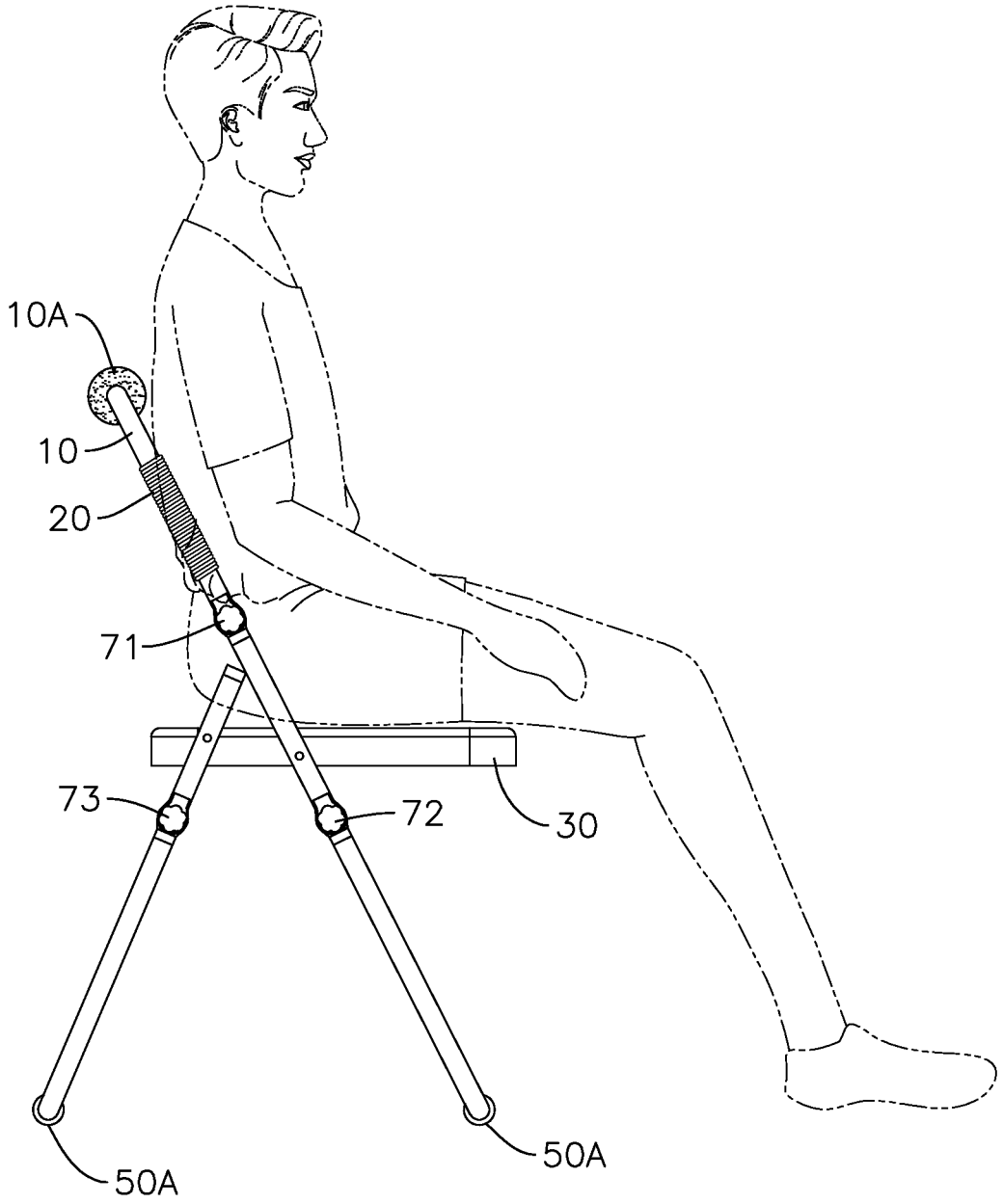
FIG. 3 is the first configuration of the multipurpose workout chair in FIG. 1.
Figure 4:
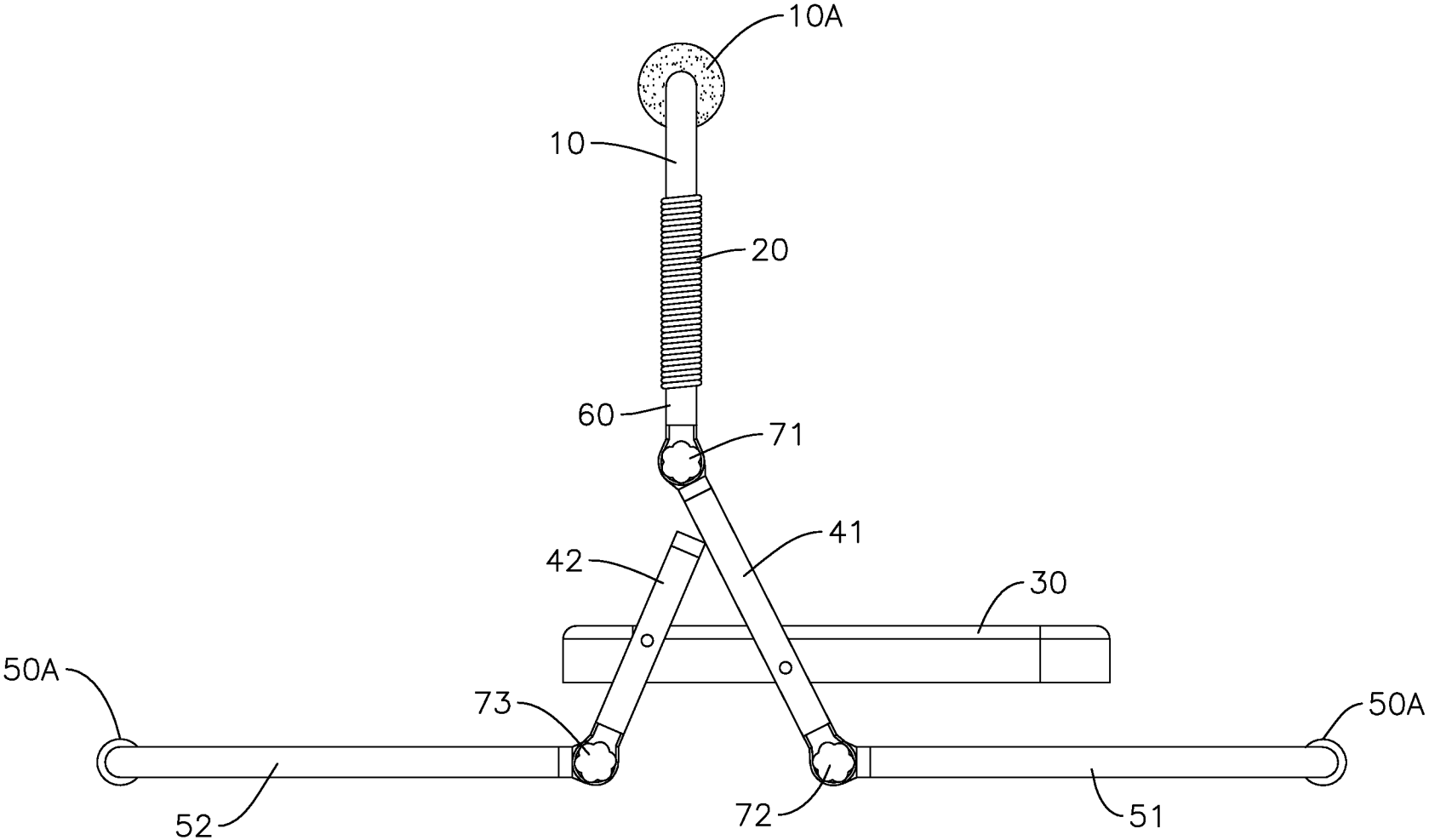
FIG. 4 is the second configuration of the multipurpose workout chair in FIG. 1.

Then please refer to FIG. 3 and FIG. 4. The first chair leg 51 and the second chair leg 52 can be respectively tilted to be horizontal by the second adjustment devices 72 and the third adjustment devices 73, making the first chair leg 51 and the second chair leg 52 parallel to the ground. The description above shows that the first configuration of the first embodiment (FIG. 3) can be turned into the second configuration (FIG. 4) of the first embodiment.

Figure 5:
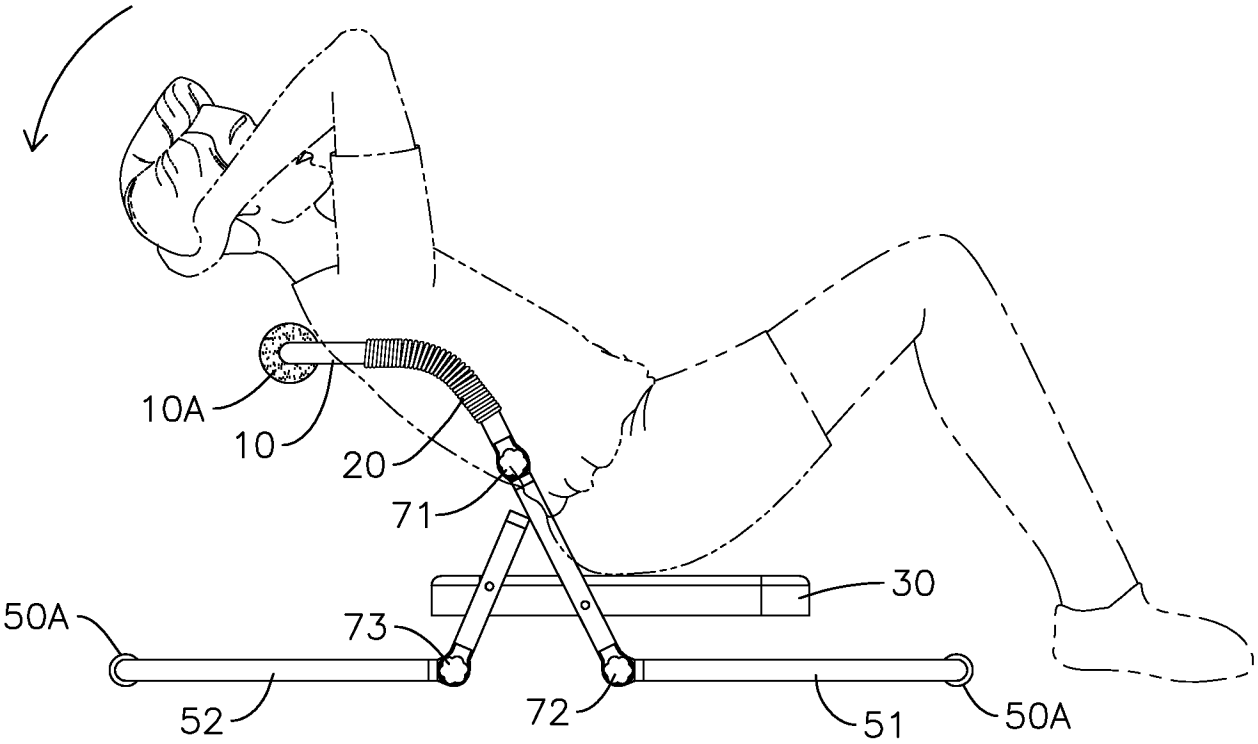
FIG. 5 is the first method of use of the multipurpose workout chair in FIG. 4.
Figure 6:
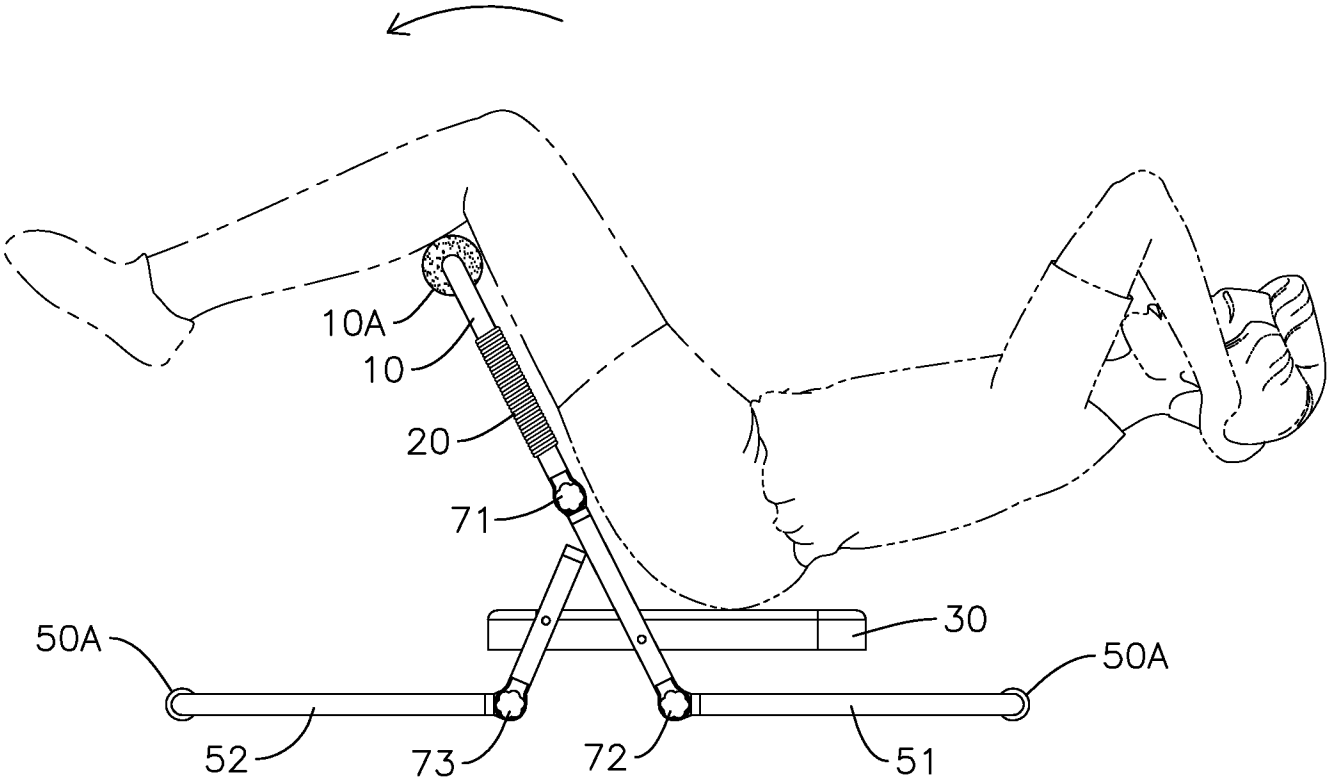
FIG. 6 is the second method of use of the multipurpose workout chair in FIG. 4.
Figure 7:
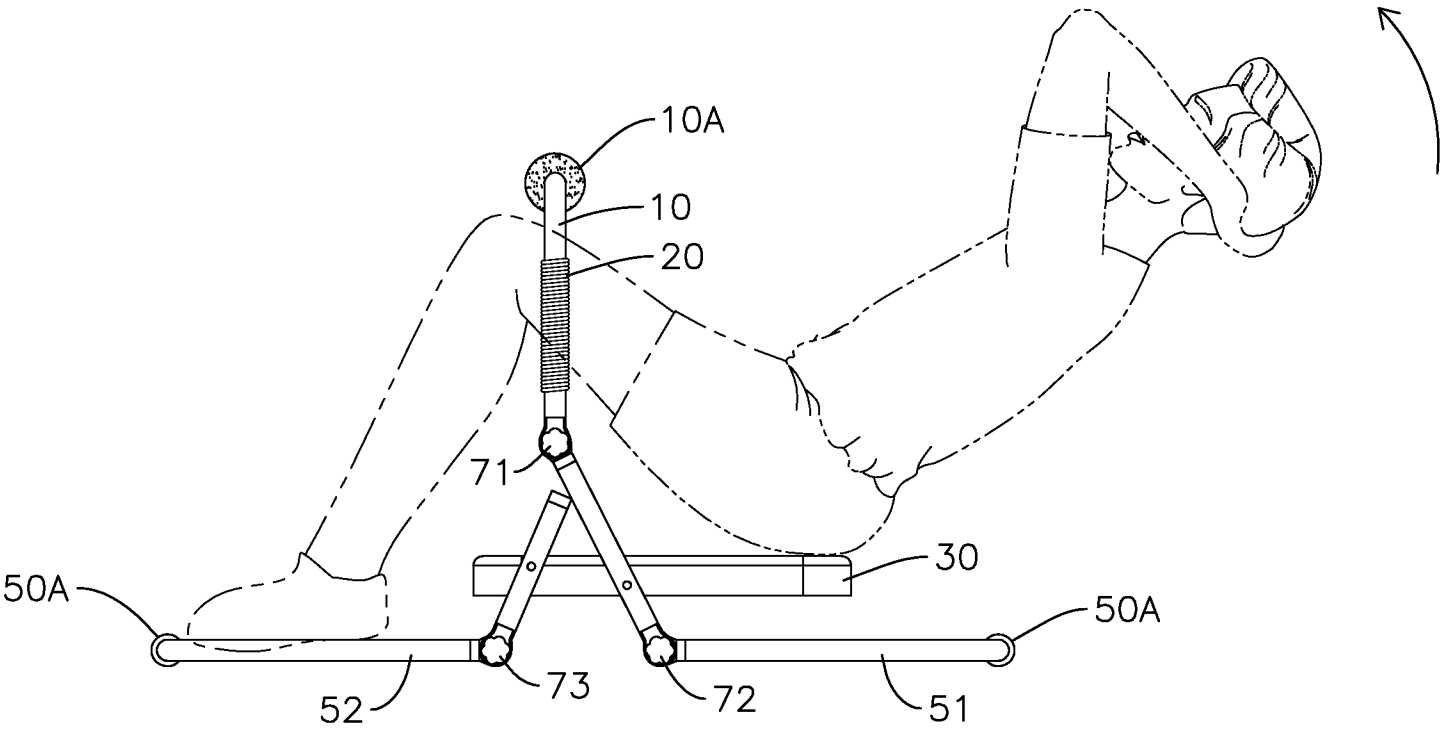
FIG. 7 is the third method of use of the multipurpose workout chair in FIG. 4.
Figure 8:
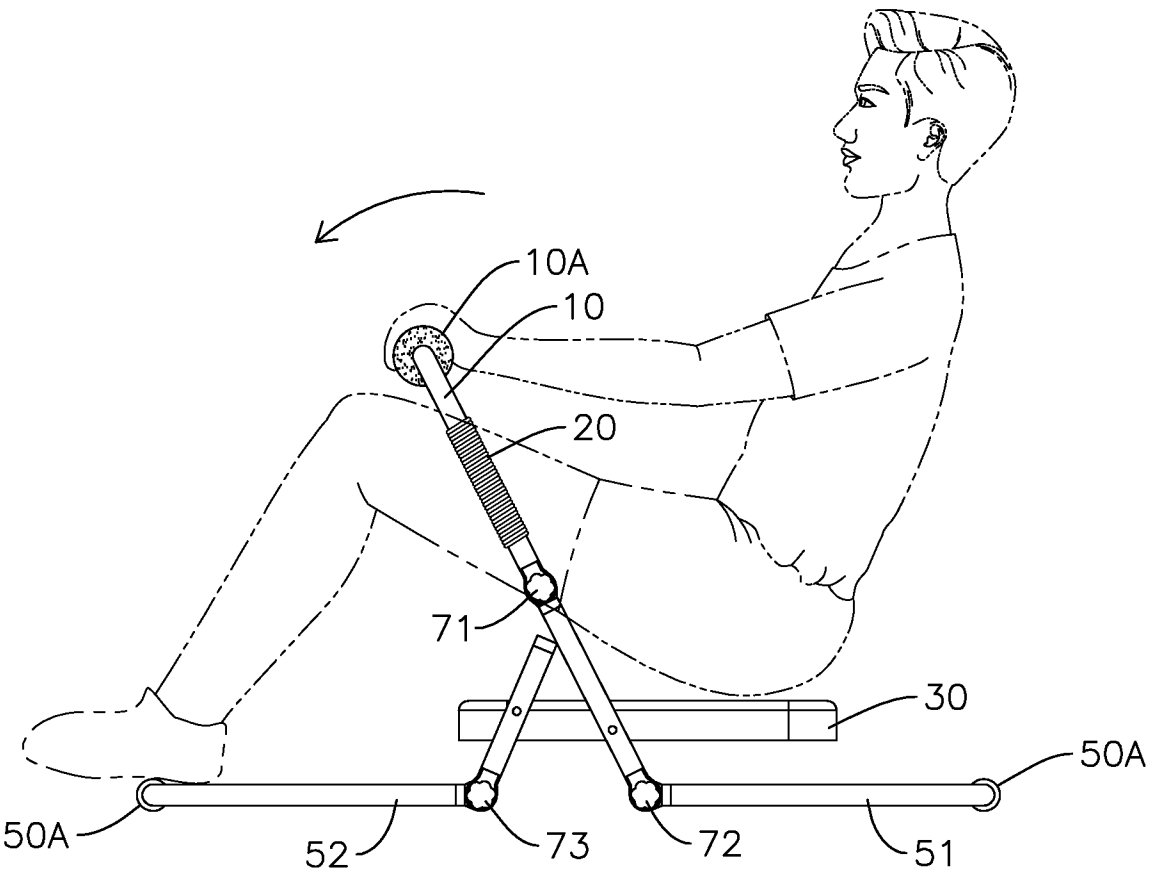
FIG. 8 is the fourth method of use of the multipurpose workout chair in FIG. 4.
Figure 9:
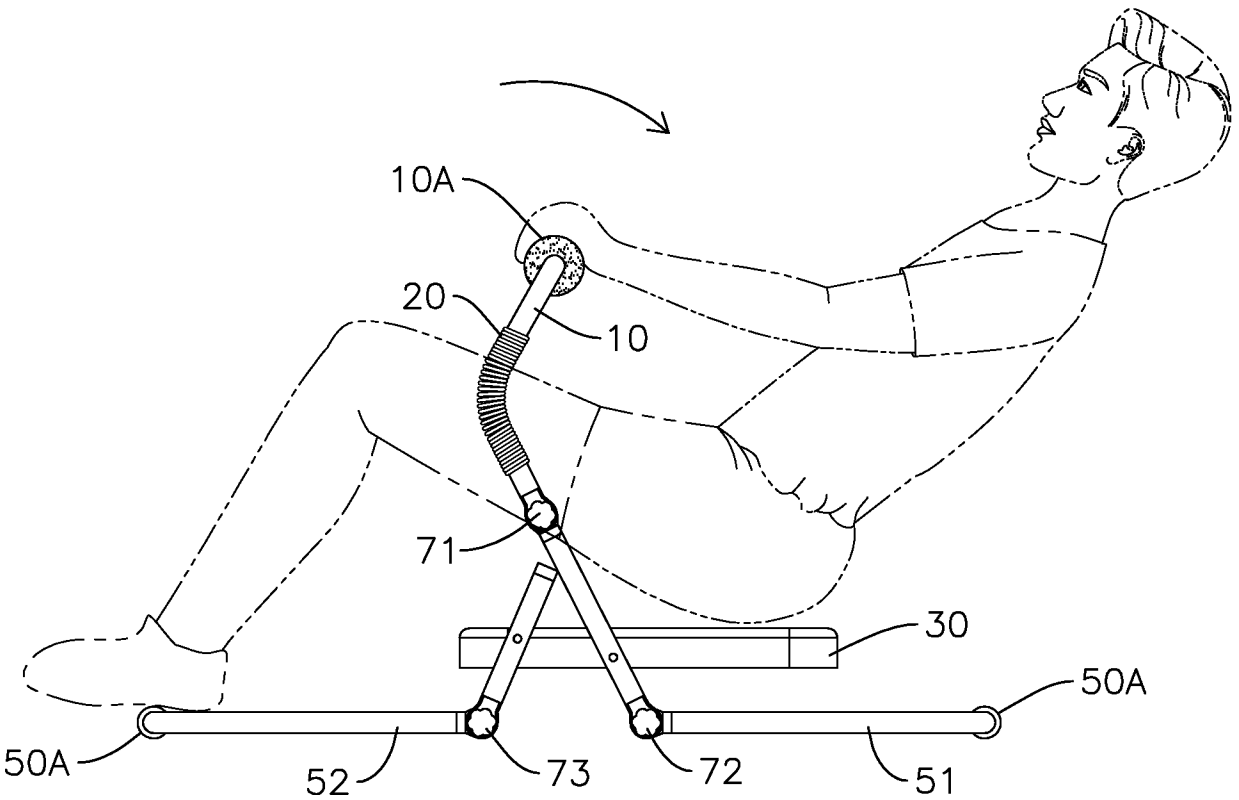
FIG. 9 shows the continuous motion of the multipurpose workout chair in FIG. 9.
Figure 10:
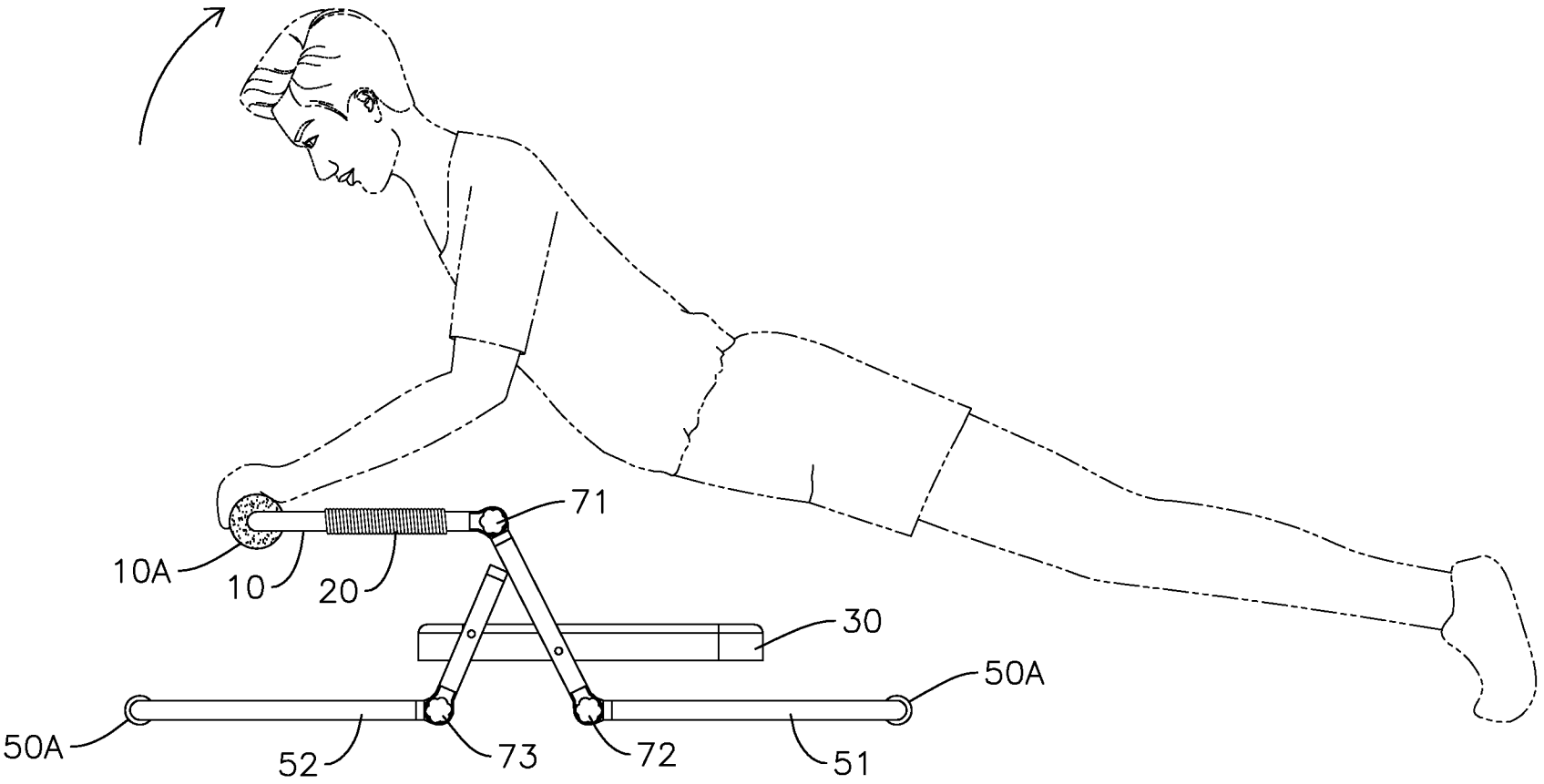
FIG. 10 is the fifth method of use of the multipurpose workout chair in FIG. 4.

Then please refer to FIG. 5 to FIG. 10. In a second configuration, the multipurpose workout chair can be used in various ways for different muscle exercises. As shown in FIG. 5, one method for using the multipurpose workout chair is that the user places the hip on the seat 30 and the back leans against the backrest 10. As shown in FIG. 6, another method for using the multipurpose workout chair is that the user places the hip on the seat 30 and faces the backrest 10, and then the user hangs both legs on the cushion pad 10A; or, as shown in FIG. 7, the user places both the legs between the power twisters 20 and leans against the cushion pad 10A for the core muscle training. Another method, as shown in FIG. 8 and FIG. 9, is that the user places both the legs between the power twisters 20 and both hands on the cushion pad 10A, and then either pushes forward or pulls backward to start the exercise. As shown in FIG. 10, another method is that the user faces the backrest 10 and puts both hands on the cushion pad 10A, then horizontally stretches the body. Then, the user's toes abut the ground to support the lower body, and meanwhile apply downward forces on the backrest 10.

In order to prevent the chair legs 50 from sliding during the exercise and affecting the outcome of the training, anti-slip pads 50A may be mounted on the first chair leg 51 and the second chair leg 52 in any one of the embodiments. The anti-slip pads 50A cover a bottom of the first chair leg 51 and a bottom of the second chair leg 52.

Figure 14:
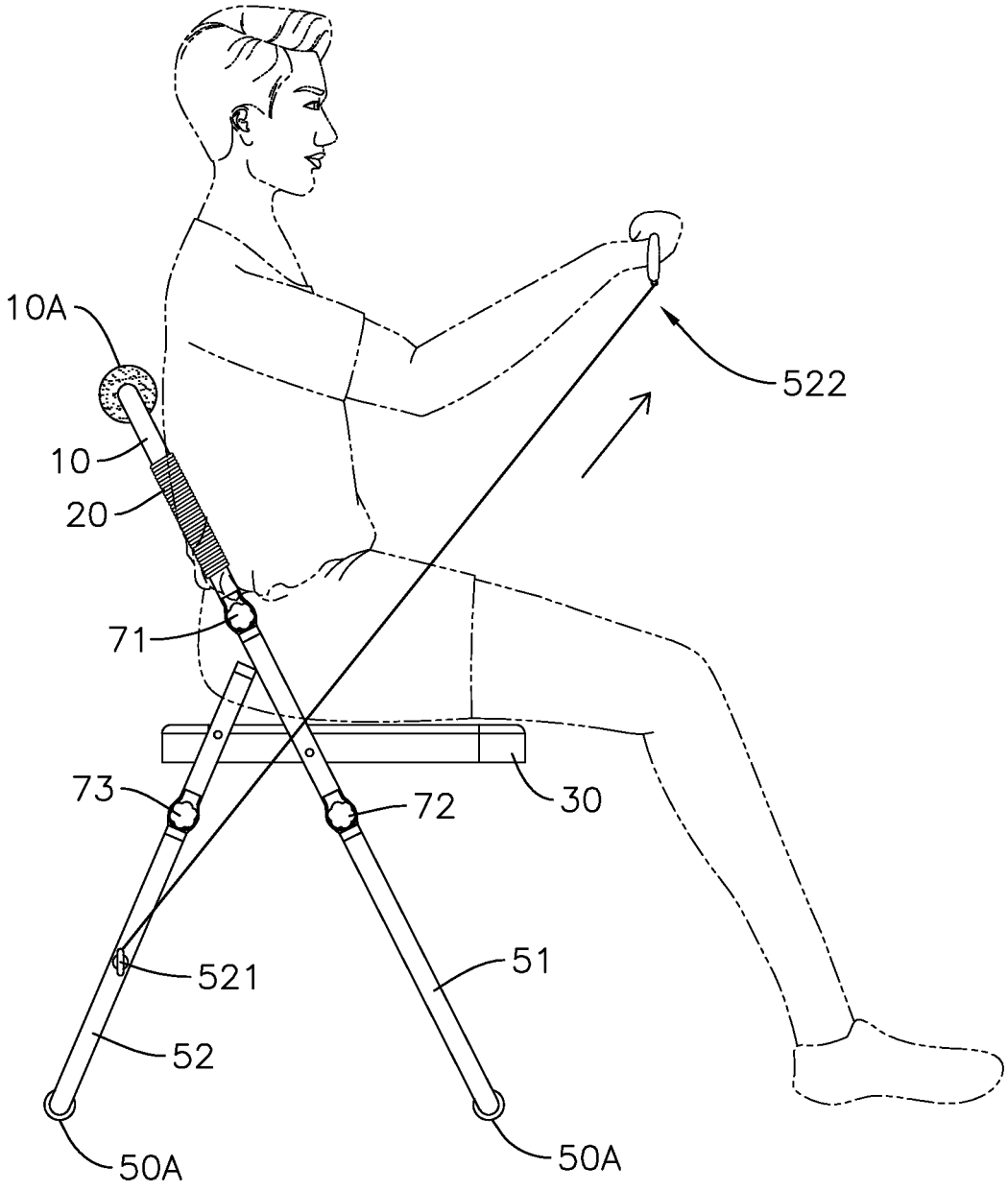
FIG. 14 is the side view of the multipurpose workout chair in accordance with a second embodiment of the present invention.

Then please refer to FIG. 14. The second embodiment of the present invention is similar to the first embodiment of the present invention; the difference is that the second chair leg 52 comprises two rings 521 and two elastic pull ropes 522. The rings 521 are mounted on two opposite sides of the second chair leg 52 and respectively connected to the elastic pull ropes 522. The user can be in a sitting position by holding the elastic pull ropes 522 in hands. Due to the resilience of the elastic pull ropes 522, the user would encounter the resistance and therefore exercise. The multipurpose workout chair is structured for allowing the user to sit thereon, and as a result the multipurpose workout chair can be used as a regular chair besides the function of exercise. In other embodiments, the rings 521 may be mounted on the first chair leg 51 or other parts of the multipurpose workout chair.

Figure 15:
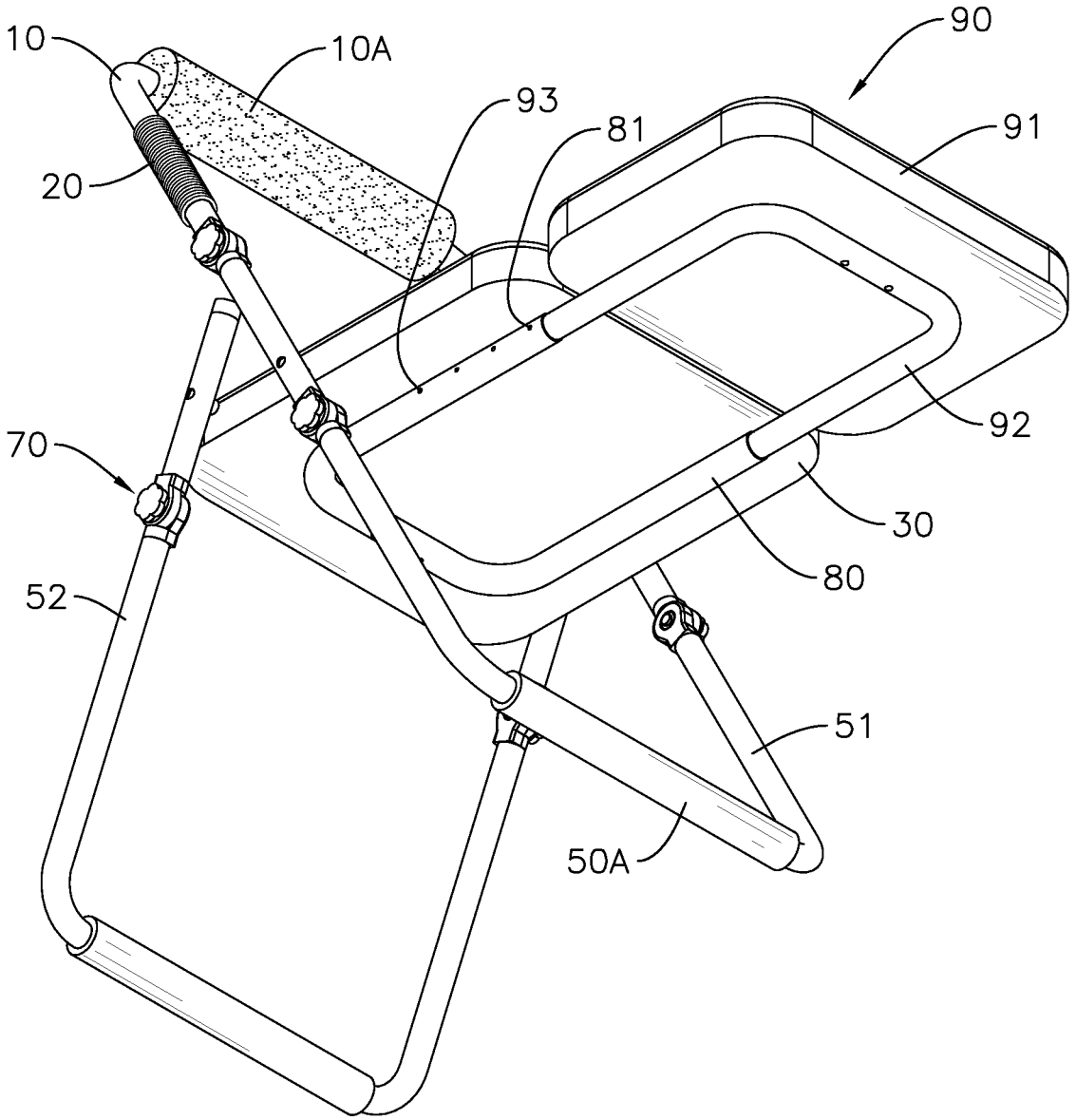
FIG. 15 is the top view of the first configuration of the multipurpose workout chair in accordance with a third embodiment.
Figure 16:
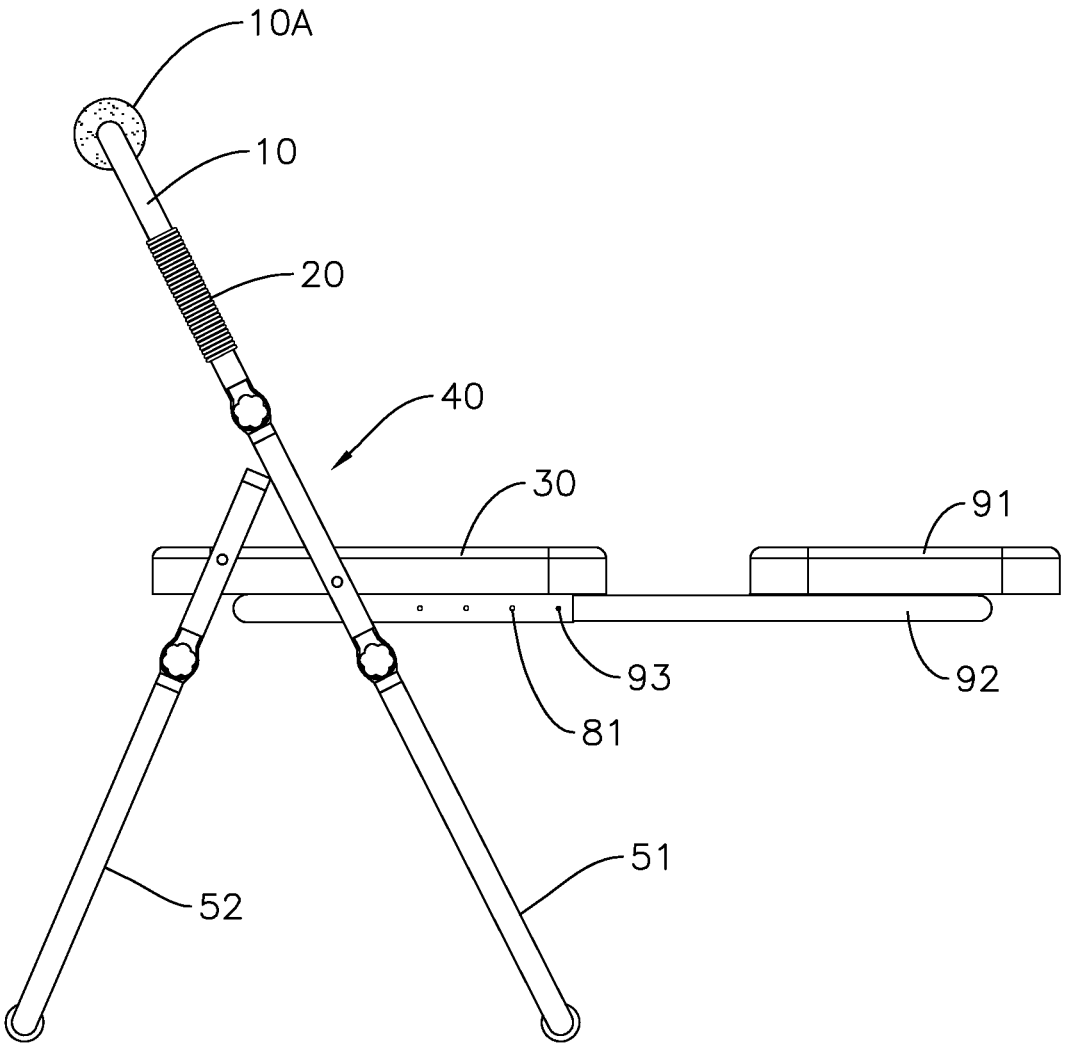
FIG. 16 is the second configuration of the multipurpose workout chair in FIG. 15.

Then please refer to FIG. 15 and FIG. 16. The third embodiment of the present invention is similar to the first embodiment or the second embodiment of the present invention. The difference is that, in the third embodiment, the multipurpose workout chair comprises two first fastening tubes 80 and a detachable extended seat 90 configured to increase the sitting area and legs support.

The first fastening tubes 80 are mounted on one surface of the seat 30 and said surface is away from the backrest 10. Each of the first fastening tubes 80 comprises multiple first fastening holes 81 evenly distributed on a wall of the first fastening tube 80. The extended seat 90 comprises a cushion block 91, two second fastening tubes 92, and two fastening components 93. The second fastening tubes 92 are mounted on a surface of the cushion block 91. Each of the second fastening tubes 92 comprises a second fastening hole. A diameter of each one of the first fastening tubes 80 is larger than that of each one of the second fastening tubes 92, and therefore the second fastening tubes 92 can be moved inside of the first fastening tubes 80. The fastening components 93 are respectively and selectively fastened through one of the first fastening holes 81 and one of the second fastening holes. Specifically, after the second fastening tubes 92 are moved to the desired position, the corresponding first fastening holes 81 are aligned with the second fastening holes. Then, the fastening components 93 are mounted through the first fastening holes 81 and the second fastening holes. Therefore relative positions of the first fastening tubes 80 and the second fastening tubes 92 are secured. Additionally, in another embodiment, the first fastening tubes 80 are detachably connected with the second fastening tubes 92 and the number of the first fastening hole on each first fastening tube 80 may be one and the number of the second fastening holes on each second fastening tube 92 may be plural.

In this embodiment, the first fastening tubes 80 may be two arms of a U-shaped tube. In another embodiment, the first fastening tubes 80 may be two individual components. In this embodiment, the fastening components 93 are respectively and selectively mounted in the second fastening tubes 92. Each of the fastening components 93 selectively protrudes outward from the second fastening tubes 92 into one of the fastening holes of the first fastening tubes 80, thereby satisfying the need for stabilization. In another embodiment, each one of the fastening components 93 may be a pin and is capable of being inward mounted through the first fastening tubes 80 and the second fastening tubes 92.

The present invention not only can be used for exercise, but also can be used as furniture. By the multiple adjustment devices 70 and other components interacting with each other, the multipurpose workout chair can be used in various ways and configurations along with the various methods, which satisfies multipurpose usage.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multipurpose workout chair comprising:
- a seat;
- two support structures respectively mounted on two opposite sides of the seat;
- a backrest having two ends opposite to each other;
- two power twisters, one end of each one of the power twisters connected to a respective one of the ends of the backrest;
- two connection components each respectively connected to another end of each one of the power twisters;
- two chair legs defined as:
  - a first chair leg; and
  - a second chair leg; and
- multiple adjustment devices defined as:
  - two first adjustment devices, each one of the first adjustment devices connecting one of the support structures and a respective one of the connection components and configured to adjust an angle between said one of the support structures and said respective one of the connection components;
  - two second adjustment devices, each one of the second adjustment devices connecting one of the support structures and a respective one of ends of the first chair leg and configured to adjust an angle between said one of the support structures and the first chair leg; and
  - two third adjustment devices, each one of the third adjustment devices connecting one of the support structures and a respective one of ends of the second chair leg and configured to adjust an angle between said one of the support structures and the second chair leg.

2. The multipurpose workout chair as claimed in claim 1, wherein each one of the two support structures comprises:
- a first support rod, two ends of the first support rod respectively connected to one of the connection components and one of the ends of the first chair leg; and
- a second support rod, two ends of the second support rod respectively connected to the first support rod and one of the ends of the second chair leg.

3. The multipurpose workout chair as claimed in claim 2, wherein the second chair leg comprises:
- two rings mounted on two opposite sides of the second chair leg; and
- two elastic pull ropes respectively connected to the rings.

4. The multipurpose workout chair as claimed in claim 3 comprising:
- two first fastening tubes mounted on one surface of the seat; each of the first fastening tubes comprising:

multiple first fastening holes evenly distributed on a wall of the first fastening tube; and an extended seat comprising:

a cushion block;

two second fastening tubes mounted on a surface of the cushion block; a diameter of each one of the second fastening tubes smaller than a diameter of each one of the first fastening tubes, therefore the second fastening tubes being moveable inside of the first fastening tubes; each of the second fastening tubes comprising a second fastening hole; and two fastening components respectively and selectively mounted in the second fastening hole and one of the first fastening holes, therefore relative positions of the second fastening tubes and the first fastening tubes being secured.

5. The multipurpose workout chair as claimed in claim 4, wherein the second fastening tubes are selectively connected with the first fastening tubes.

6. The multipurpose workout chair as claimed in claim 5 comprising:

two anti-slip pads respectively mounted on the first chair leg and the second chair leg, the anti-slip pads respectively covering a bottom of the first chair leg and a bottom of the second chair leg.

7. The multipurpose workout chair as claimed in claim 6, wherein the backrest comprises a cushion block.

8. The multipurpose workout chair as claimed in claim 7, wherein the first chair leg and the second chair leg are tiltable to be horizontal.

9. The multipurpose workout chair as claimed in claim 1, wherein each one of the first adjustment devices comprises:

a first base connected to the corresponding one of the connection components and comprising multiple first gear teeth; and a second base connected to the corresponding one of the support structures and comprising multiple second gear teeth; the second gear teeth selectively engaged with the first gear teeth; wherein when the second gear teeth are engaged with the first gear teeth, the first base is non-rotatable with respect to the second base.

10. The multipurpose workout chair as claimed in claim 9, wherein each one of the first adjustment devices comprises:

a threaded component mounted through the first base and the second base, the threaded component comprising:

a first end screwed on the first base;

a second end configured to detach the second base toward the first base;

a detaching spring mounted between the first base and the second base and configured to separate the first base and the second base.

11. The multipurpose workout chair as claimed in claim 1 comprising:

two first fastening tubes mounted on one surface of the seat; each of the first fastening tubes comprising:

multiple first fastening holes evenly distributed on a wall of the first fastening tube; and an extended seat comprising:

a cushion block;

two second fastening tubes mounted on a surface of the cushion block; a diameter of each one of the second fastening tubes smaller than a diameter of each one of the first fastening tubes, therefore the second fastening tubes being moveable inside of the first fastening tubes; each of the second fastening tubes comprising a second fastening hole; and two fastening components respectively and selectively mounted in the second fastening hole and one of the first fastening holes, therefore relative positions of the second fastening tubes and the first fastening tubes being secured.

12. The multipurpose workout chair as claimed in claim 11, wherein the second fastening tubes are selectively connected with the first fastening tubes.

13. The multipurpose workout chair as claimed in claim 1, wherein the second chair leg comprises:

two rings mounted on two opposite sides of the second chair leg; and two elastic pull ropes respectively connected to the rings.

14. The multipurpose workout chair as claimed in claim 1 comprising:

two anti-slip pads respectively mounted on the first chair leg and the second chair leg, the anti-slip pads respectively covering a bottom of the first chair leg and a bottom of the second chair leg.

15. The multipurpose workout chair as claimed in claim 1, wherein the backrest comprises a cushion block.

16. The multipurpose workout chair as claimed in claim 1, wherein the first chair leg and the second chair leg are tiltable to be horizontal.

* * * * *